United States Patent [19]

Schine

[11] Patent Number: 4,703,319

[45] Date of Patent: Oct. 27, 1987

[54] SELECT SWITCH BOX FOR WHITE ON BLACK AND BLACK ON WHITE CRT DATA DISPLAY

[75] Inventor: Jonathan M. Schine, Los Angeles, Calif.

[73] Assignee: High Resolution Sciences, Inc, Los Angeles, Calif.

[21] Appl. No.: 773,336

[22] Filed: Sep. 6, 1985

[51] Int. Cl.[4] ..... G09G 1/14

[52] U.S. Cl. ..... 340/723; 340/715; 358/22

[58] Field of Search ..... 340/709, 715, 723; 358/22, 183

[56] References Cited

U.S. PATENT DOCUMENTS

| | | | |
|---|---|---|---|
| 3,757,051 | 9/1943 | Girard et al. | 178/70 R |
| 3,758,717 | 9/1973 | Granzotti | 340/723 |
| 4,212,008 | 7/1980 | Hopkins, Jr. | 340/723 |
| 4,274,094 | 6/1981 | Noguchi | 340/723 |
| 4,360,804 | 11/1982 | Ohura | 340/723 |

*Primary Examiner*—Marshall M. Curtis
*Assistant Examiner*—Mahmoud Fatahiyar
*Attorney, Agent, or Firm*—Freilich, Hornbaker, Rosen & Fernandez

[57] ABSTRACT

A three-pole double-throw switch is provided to selectively interrupt the video signal from an input connector to an output connector for display of white characters generated by a microprocessor on a dark screen of a CRT monitor, or vice versa, and route the video signal through an inverter for display of dark characters on white screen. One pole of the switch is used to provide the vertical sync signal to the power input terminal of the inverter, thus powering the select switch box solely from the transmitted vertical sync signal. A capacitor filters the power supply thus provided. The select switch box requires no external power and is virtually free of RF energy radiation while providing noise free data display with equal bandwidth response in both modes.

3 Claims, 3 Drawing Figures

SELECT SWITCH BOX FOR WHITE ON BLACK AND BLACK ON WHITE CRT DATA DISPLAY

BACKGROUND OF THE INVENTION

This invention relates to a video display terminal, particularly of the raster-scan cathode ray tube type adapted for display of text and other similar data, although the invention may be used with video display of graphics as well.

The most common video display system for a microprocessor utilizes a CRT monitor, particularly when the user needs to verify data that is being entered, and data that is to be printed, or simply needs to follow the programs of data being processed. The most common form of alphanumeric data display is the dot matrix display described in U.S. Pat. No. 3,345,458.

In a dot matrix display, each character in a line of text is created by a series of dots as a line of characters is scanned raster by raster with 9 or 10 rasters for a matrix of 7×9 or 8×10 dots per character. The microprocessor stores the data to be displayed in a random access memory (RAM), and the data display system reads each line of data one line at a time for display. A character generator implemented with a read only memory (ROM) converts the line of data into properly spaced sequences of dots for each raster scan to produce the characters of the entire line, as described in a copending application Ser. No. 686,219.

The usual CRT display is white characters on a dark (gray or green) background. On occasion, or for some particular operations, dark characters on a white background are desired. An object of this invention is to provide the facility for selecting dark on white or white on dark display without altering the existing microprocessor and data display system using a select switch box that is plugged in between the microprocessor and the display monitor with the existing cable to the CRT display unit and a cable to the microprocessor, or either directly to the display monitor with a cable to the microprocessor or directly to the microprocessor with a cable to the display monitor, and in each case without requiring FCC or UL approval for the switch box. Normally the Federal Communications Commission (FCC) requires equipment employed in the transmission of data to meet strict specifications with respect to electromagnetic radiation shielding if it is capable of electromagnetic radiation, in order to be approved by the FCC, and any equipment connected to power lines used must be tested and approved by Underwriters Laboratories (UL).

SUMMARY OF THE INVENTION

In accordance with the present invention, a male (or female) connector of the type used to plug the CRT cable into the microprocessor is provided as part of a selector switch box, and a female (or male) connector of the type into which the CRT cable is normally plugged is also provided as part of the select switch box. For convenience, the connectors will hereafter be referred to generically as just "connectors" which may be of either type, and reference will be made to pins, although if the connector is the female type, the "pins" are, of course, receptacles for pins. The pins of the conectors are connected directly within the box, pin 1 to pin 1, pin 2 to pin 2, etc., except for the pin which carries the video signal from the microprocessor. The corresponding pins for the video signal are connected by an inverter having its input connected to the pin of the input (microprocessor) connector, and its output connected to the pin of the output (monitor) connector, and connected by a three-pole double-throw switch operable from outside the box to disconnect the inverter input and output, and connect the video input pins directly for white on dark background display. Thus, to invert the display to dark on white background display, the switch is turned "on," and the inverter causes the video signal to present the data as dark on white background. The normal "off" position of the switch will thus transmit the video signal directly to corresponding pins of the input and output connectors.

To power the inverter, the pin for the vertical sync signal is connected to the inverter so that the +4 V vertical sync signal may be used as the source of power supply. A capacitor connected between that pin and a pin assigned to ground the CRT monitor to the ground of the microcomputer functions as a power supply filter. Besides the capacitor and the three-pole double-throw switch, there is a resistor connected between the input of the inverter and the ground pin to terminate the input conductor with its characteristic impedance so there will be no reflections on the line.

In the off position, the power supply terminal of the inverter is connected to an open terminal, the video input pin is connected directly to the video output pin of the connectors, and in the on position the power supply terminal of the inverter is connected to the vertical sync input or output pin of the connectors, the video input pin of the microprocessor connector to the input terminal of the inverter, and the output pin of the monitor connector to the output terminal of the inverter.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
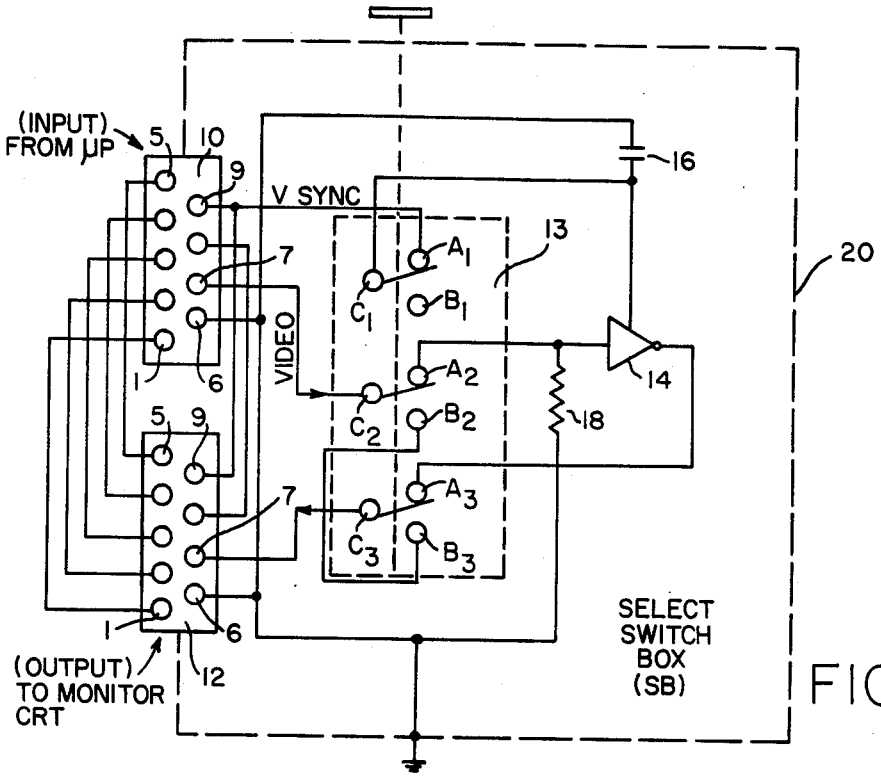
FIG. 1 is a schematic diagram of a select switch box according to the present invention.

Referring to FIG. 1, there is shown in generic form two connectors 10 and 12, the connector 10 to plug into the microprocessor and the connector 12 to plug into the CRT monitor, either directly or through a cable at either end. It is not important to the invention as to whether one is male or female, or as to whether the other is female or male. All that is important is that they have corresponding pins or receptacles numbered 1 through 9. Assuming male connectors, like pins are connected directly together except the video intensity signal pin 7 and the vertical sync signal pin 9. These pins are connected to contacts of a three-pole double-throw switch 13 in the following manner: pin 9 of either connector 10 or 12 to contact $A_1$; and pin 7 of connector 10 to the moving contact $C_2$ and pin 7 of connector 12 to the moving contact $C_3$. Contacts $B_2$ and $B_3$ are connected together, and contact $B_1$ is left open.

The moving contact $C_1$ provides power (+4 Vdc) to an inverter 14, such as a 74HCO4 high performance CMOS (low-power complementary MOS silicon) gate. The contact $A_2$ is connected to the input of the inverter 14, and the contact $A_3$ is connected to the output of the inverter 14. A capacitor 16 (50 pf) is connected between the moving contact $C_1$ and circuit ground to filter the power supply thus provided by the vertical sync signal, and a resistor 18 is connected between the contact $A_2$ and circuit (chassis) ground. Note that pins 6 of the connectors provide a common circuit ground between the microprocessor and the CRT monitor (not shown in FIG. 1), and that the connectors are conventional in that their housings are metal to make electrical connection bewteen them, thus assuring that the microprocessor and monitor are at the same reference ground. For instance, the outer conductors of a coaxial cable are "grounded" at the monitor and microprocessor, and connected to the connector housings so that the monitor and microprocessor have a common ground. The select switch box is than connected to the connector housings to provide a common ground for the circuit. If the "box" is provided in the form a potting compound, the circuit ground could be provided by connections to pins 6, such as through a circuit board, while connecting the pins 6 to the ground conductors of the cables to the monitor and microprocessor. This is represented by a ground symbol connected to pins 6.

When the three-pole double-throw switch is in the "on" position shown, the video signal at pin 7 of the connector 10 to the microprocessor is inverted and applied to the CRT monitor via the inverter 14 and pin 7 of the connector 12. When the switch is placed in its alternate "off" position, the connection for power supplied to the inverter via pin 9 of the connector 10 is open, and the video signal at pin 7 of the connector 10 bypasses the inverter 14 through contacts $B_2$ and $B_3$. The "off" position provides conventional white character display on a dark background. The "on" position provides dark character display on a white background. This is so because the video signal which normally intensifies the electron beam for a white dot to be displayed is inverted to virtually shut off the electron beam for a dot generation, thus leaving the CRT screen dark, and intensifies the electron beam at all other times.

Figure 2:
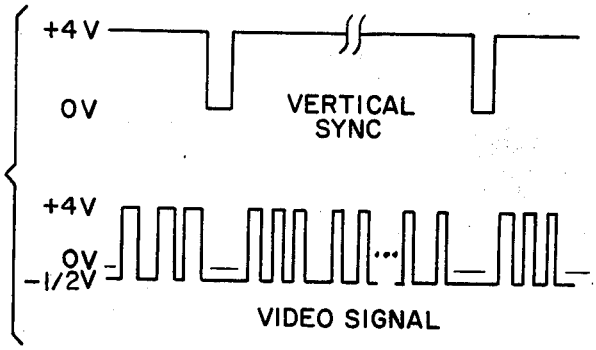
FIG. 2 illustrates waveforms for the vertical sync signal and the video signal of typical CRT data display system

FIG. 2 illustrates in waveform A the vertical sync signal typically provided to the CRT monitor. It is typically high (+4 V) and drops to a low (0 V) during vertical scan retrace at the end of each sequence of raster scans that fill the CRT monitor screen. Waveform B illustrates a typical video signal which may vary from a high (+4 V) to a low (about −0.5 V) according to the characters displayed. A white dot display on a dark background would normally be produced by a high video signal, but in the "on" position of the switch 13 shown in FIG. 1, the video would be inverted, and the dot display would become a dark dot on a white background, or vice versa. In that way, the select switch box shown in FIG. 1, in which the "box" is represented by a dotted line 20, provides the selection of black on white, or white on black for data display without the need for any external power and with equal bandwidth response for both selections.

The select switch box is noise free, injects no interference in the video signal and places no dc on the pins that is not otherwise present. Consequently, the select switch box requires no FCC approval since it will not radiate RF energy, and requires non UL approval (or the equivalent) since it does not connect to any outside source of power. The very low power required ($V_{cc}$) by the inverter is derived from the vertical sync signal at +4 V. When the inverter is driven by a high input (+4 V), its output will be low (0 to −0.5 V), and vice versa. For that reason the inverter, functions as a logic gate such that the output Y in response to an input A is equal to the complement $\overline{A}$.

Figure 3:
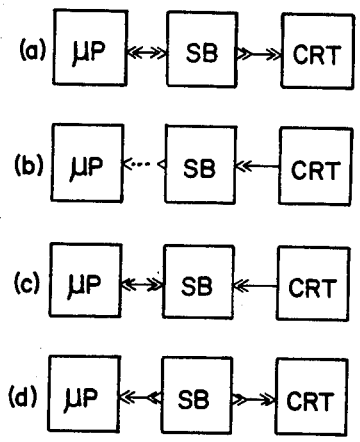
FIG. 3 illustrates many variations on the combinations of connectors and cables used with a select switch box of the present invention.

The description of FIG. 1 was with generic terminology for the connectors 10 and 12. Normally the connector 10 would be a male connector, and the connector 12 would be a female connector which normally receives the male connector at the end of a coaxial cable provided with the CRT monitor. That is the first arrangement illustrated in FIG. 3(*a*), but other possibilities are illustrated in FIG. 3(*b*) through 3(*d*). Still other possibilities will occur to those skilled in the art.

A preferred arrangement would be two male connectors for the select switch box with cables to both the microprocessor and the CRT monitor as illustrated in FIG. 3(*b*), but one connector may be a female connector as shown in FIG. 3(*c*) for connection to the microprocessor with a cable having a male connector at both ends, or both connectors may be female connectors as shown in FIG. 3(*d*).

Note that the possibilities illustrated in FIGS. 3(*a*) and (*d*) assume the CRT monitor has a fixed cable with a male connector at the end. This is quite common, so if the select switch box is provided with two male connectors, a short patch cable with two female connectors will be required. Still other possibilities may occur, as noted hereinbefore. Consequently, the term connectors used in the claims to define the invention is to be construed generically to apply to either a male or a female connector. The qualification "input" or "output" will distinguish which is to be connected to the microprocessor and which is to be connected to the monitor. Also the term "pin" is to be construed generically to apply to either a pin of a male connector, or a receptacle for a pin in a female connector. Finally, the term box as used herein may be a metal or plastic box, or simply a mass of plastic of any suitable shape into which all elements, including the connectors, have been potted or encapsulated. The only difference between potting and encapsulating is that in potting, the container for the potting compound remains as part of the assembly, whereas in encapsulating, the container (mold) is removed after the encapsulating material has set (solidified). The "box" itself need not be grounded, although in the case of a metal box, it would be good practice to connect it to one of the ground pins.

What is claimed is:

1. A selector switch box for selecting display of data on a CRT monitor utilizing at least a vertical synch signal and a video signal generated by a microprocessor to be white on a dark background or dark on a white background, comprising an input connector to be connected to the microprocessor and an output connector to be connected to the CRT monitor, said connector having matching pins connected together directly including two pins for providing a common ground for said microprocessor and said CRT monitor, said matching pins including two pins for except one pin of the input connector for the video signal and one pin of the output connector for the video signal, a three-pole double-throw switch having three pairs of contacts $A_1$, $B_1$; $A_2$, $B_2$; and $A_3$, $B_3$ and moving contacts $C_1$, $C_2$ and $C_3$ for selectively making contact with either one of respective contacts $A_1$, $A_2$ and $A_3$, and $B_1$, $B_2$ and $B_3$, an electrical connection between contact $A_1$ and a pin of said connectors through which said vertical sync signal is transmitted by said microprocessor to said CRT monitor, an electrical connection between contact $A_2$ and a pin of said connectors through which said video signal is transmitted by said microprocessor to said CRT monitor, an electrical connection between contact $B_2$ and contact $B_3$, and an inverter having its input terminal connected to contact $A_2$, its output terminal connected to contact $A_3$, its power input terminal connected to moving contact $C_1$, and its ground terminal connected to one of said connector pins connected directly to provide a common ground for the microprocessor and the CRT monitor.

2. A selector switch box as defined in claim 1 including a capacitor connected between contact $C_1$ and said ground for filtering power provided by said vertical sync signal during periods between blanking pulses when the vertical sync signal goes from +V to 0 V.

3. A selector switch box as defined in claim 2 including an input bias resistor for said inverter connected between contact $A_2$ and said ground.

* * * * *